United States Patent [19]

Collins

[11] Patent Number: 4,512,289

[45] Date of Patent: Apr. 23, 1985

[54] WATER HEATER WITH COMBINATION MAGNETIC AND AGITATOR MEANS

[75] Inventor: Denver G. Collins, Ashland City, Tenn.

[73] Assignee: State Industries, Inc., Ashland City, Tenn.

[21] Appl. No.: 614,978

[22] Filed: May 29, 1984

Related U.S. Application Data

[63] Continuation of Ser. No. 561,055, Dec. 13, 1983, abandoned, and a continuation of Ser. No. 380,521, May 12, 1982, abandoned.

[51] Int. Cl.[3] ..... F22B 37/18

[52] U.S. Cl. ..... 122/380; 210/222; 122/159

[58] Field of Search ..... 122/159, 406 R, 407, 122/408 R, 380, 390; 210/222

[56] References Cited

U.S. PATENT DOCUMENTS

| | | | |
|---|---|---|---|
| 3,355,024 | 11/1967 | Skoyles et al. | 210/222 |
| 3,511,776 | 5/1970 | Avampato | 210/222 |
| 3,841,486 | 10/1974 | Heitmann et al. | 210/222 |
| 3,869,390 | 3/1975 | Heitmann et al. | 210/222 |
| 3,923,660 | 12/1975 | Kottmeier | 210/222 |
| 3,979,288 | 9/1976 | Heitmann et al. | 210/222 |
| 4,031,011 | 6/1977 | Dorgathen | 210/222 |
| 4,157,077 | 6/1979 | Lindahl | 122/159 |
| 4,216,092 | 8/1980 | Sholhoob et al. | 210/222 |
| 4,263,879 | 4/1981 | Lindahl | 122/159 |

*Primary Examiner*—Henry C. Yuen

*Attorney, Agent, or Firm*—Michael, Best & Friedrich

[57] ABSTRACT

A water heater having a magnetic device connected to a source of water under pressure and to the water heater inlet. The magnetic device includes a plurality of permanent magnet members mounted on a tube. Water flowing thru the tube to the water heater inlet will flow thru the magnetic lines of force produced by the permanent magnet members. An agitator assembly is mounted in the bottom portion of the tank and includes a ring-shaped tubular member and a secondary tubular member connected to the ring-shaped tube. The ring-shaped member is provided with a plurality of openings in the sides thereof and the secondary tubular member is provided with an upwardly facing opening therein. The agitator assembly is connected to the magnetic device so that when hot water is periodically withdrawn from the top of the tank, water will flow into the tank from the magnetic device and then out thru the openings in the agitator assembly to produce a stirring action in the bottom of the tank.

1 Claim, 4 Drawing Figures

WATER HEATER WITH COMBINATION MAGNETIC AND AGITATOR MEANS

This is a continuation of application Ser. No. 561,055, filed Dec. 13, 1983, now abandoned, and a continuation of application Ser. No. 380,521 filed May 12, 1982, now abandoned.

BACKGROUND OF THE INVENTION

I. Field of the Invention

This invention relates to water heaters and more particularly to a water heater equipped with a specially designed combination magnetic means and agitator means which are effective to prevent accumulation of scale and other solid particles in the bottom portion thereof.

II. Description of the Prior Art

A longstanding problem in the water heater industry is the tendency of dissolved solid particles to precipitate out of the water being heated, which particles will accumulate in the bottom of the tank causing adverse operation and tank longevity. One prior approach designed to reduce this problem is described in U.S. Pat. No. 4,263,879. The object of the present invention is to improve upon the invention of such patent.

SUMMARY OF THE INVENTION

A water heater having an outlet means in the top thereof for periodically withdrawing heated water from the heater. A cold water inlet is located in the bottom portion of the heater for admitting cold water into the water heater tank when hot water is withdrawn from the outlet. A magnetic means is provided which has an inlet connected to a source of water under pressure and an outlet connected to the water heater inlet. The magnetic means includes a plurality of permanent magnets which produce magnetic lines of force through which the incoming cold water flows causing precipitated solids to build up on each other as opposed to becoming adhered to the interior surfaces of the water heater. The combination of the present invention further includes an agitator assembly mounted in the bottom portion of the tank which operates to create a stirring action in the bottom portion of the tank to thereby cause solid materials in the water to be maintained in suspension and ultimately carried upwardly in the tank and out the outlet thereof. The magnetic means operates to make the stirring action of the agitator means more effective.

DESCRIPTION OF THE PREFERRED EMBODIMENT

Figure 1:
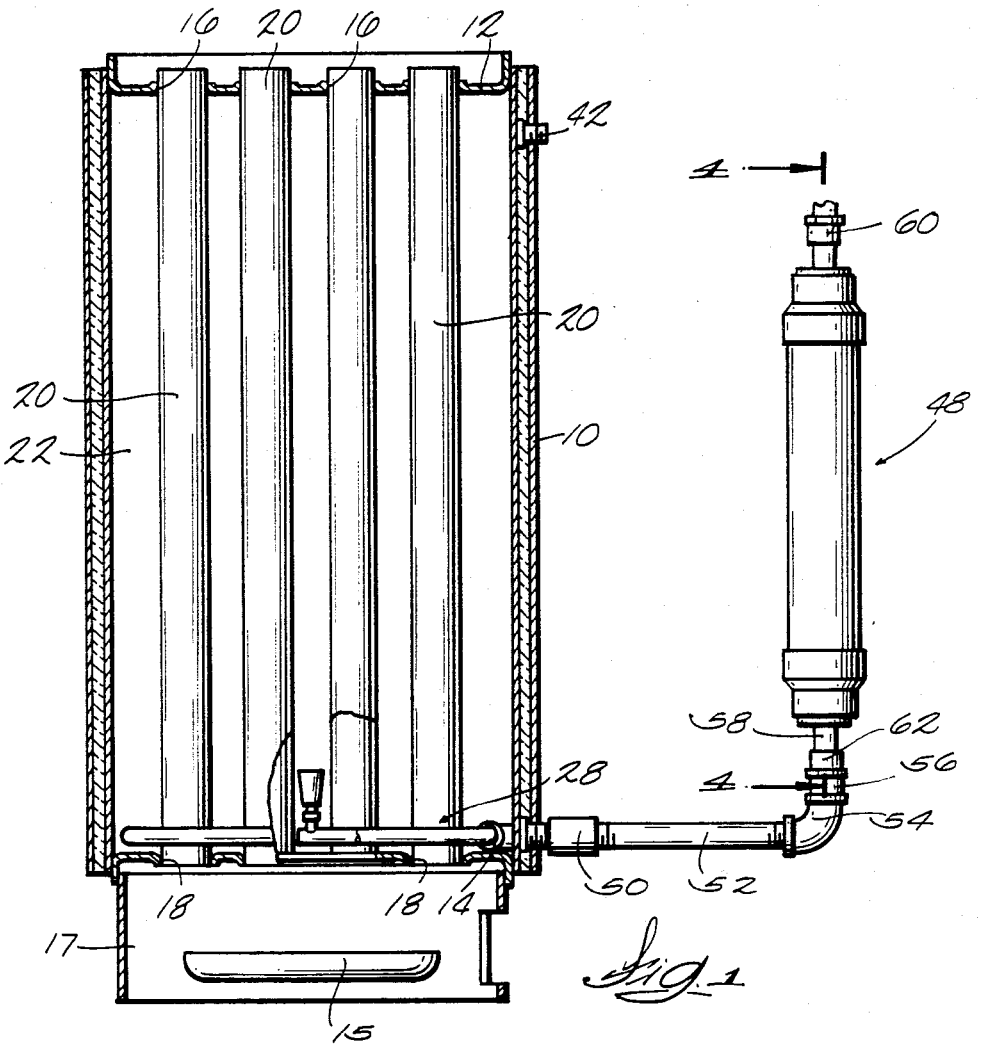
FIG. 1 is a side elevation view (with parts broken away) of a water heater which incorporates the subject matter of the present invention.

Referring to the drawings in detail, the water heater of the present invention is comprised of an insulated tank wall 10, a tank top member 12 and a tank bottom member 14. In a gas fired water heater a burner 15 of conventional construction is mounted in the space 17 below tank bottom member 14. Also in a gas fired water heater, top and bottom members 12 and 14 are provided with a plurality of aligned openings 16 and 18, respectively, in which flue tubes 20 are mounted. Tank top and bottom members 12 and 14 are sealed to the tank wall 10 and to the flue tubes 20 by any suitable means such as welding to form a liquidtight tank having a water heating chamber 22 within.

Figure 2:
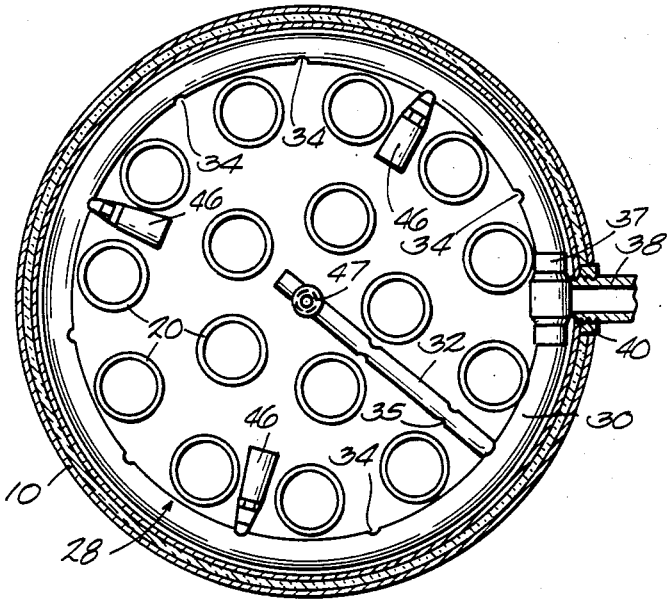
FIG. 2 is a sectional view taken along line 2—2 of FIG. 1.

Mounted in the lower portion of the tank chamber 22 is an agitator assembly 28 comprised of a circular ring portion 30 and a secondary straight tube portion 32 connected thereto. Ring portion 30 is dimensioned to fit closely adjacent the inside wall of wall 10 as best shown in FIG. 2. Straight portion 32 of assembly 28 is dimensioned to extend from a connection point on the inner side of ring portion 30 between flue tubes 20 in a substantially radial direction towards the center of the chamber 22.

Both the ring portion 30 and the straight portion 32 of assembly 28 are provided with a plurality of openings 34 and 35 in the sides of the two portions, respectively, and a single opening 36 near the end of portion 32. The end of tube portion 32 is closed. Openings 34 in the sides of ring portion 30 face toward the center of the tank and openings 35 in straight portion 32 face to opposite sides of portion 32. Opening 36 in portion 32 faces upwardly.

The assembly 28 is provided with any suitable pipe fitting arrangement such as a T-fitting 37, a nipple 38 and a bushing 40 (as best shown in FIG. 2) for connecting the assembly to a source of water under pressure. A hot water outlet fitting 42 is provided at the upper portion of wall 10 as shown in FIG. 2.

Figure 3:
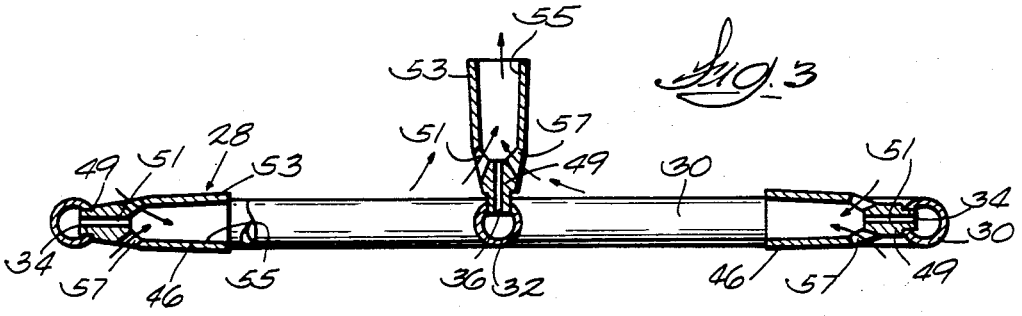
FIG. 3 is an enlarged fragmentary view taken along line 3—3 of FIG. 2.

As best shown in FIGS. 2 and 3, a plurality of venturi fittings 46 are mounted in openings 34 in portion 30 of the agitator assembly. A venturi fitting 47 is mounted in opening 36 in portion 32. Venturi fittings 46 and 47 are comprised of an externally threaded base portion 49 having a small diameter passageway 51 therethrough and a tip portion 53 having a larger diameter passageway 55 therethrough. A plurality of side openings 57 are provided adjacent the area where the end of passageway 51 opens into passageway 55. As best shown in FIG. 2, in the preferred embodiment, three venturi fittings 46 are mounted in ring portion 30. Fittings 46 and straight portion 32 are approximately equaly spaced around ring portion 30.

As shown in FIG. 1, a magnetic device 48 is connected to the agitator assembly inlet by any suitable plumbing arrangement which, as shown in the drawings, is comprised of a coupling 50, a nipple 52, an elbow 54 and a nipple 56.

Figure 4:
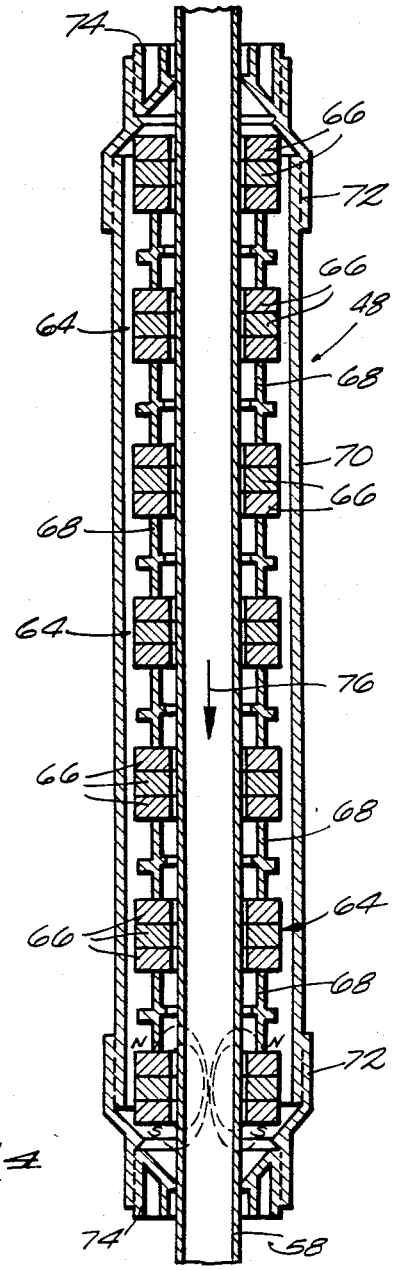
FIG. 4 is a sectional view taken along line 4—4 of FIG. 1.

Referring to FIG. 4, the preferred embodiment of magnetic device 48 is comprised of a length 58 of copper tubing having copper adaptor connectors 60 and 62 mounted on opposite ends thereof by sweat soldering or other suitable means.

Spaced along the exterior of tube 58 are a plurality of permanent magnet assemblies 64, each of which is comprised of one or more doughnut-shaped permanent magnet members 66 positioned immediately adjacent each other.

Magnet assemblies 64 are axially spaced on tube 58 by plastic spacer members 68. A jacket assembly for the magnet assemblies is comprised of a outer tubular member 70, end cap members 72, 72, and bushing members 74, 74. Jacket members 70, 72 and 74 are made of a non-magnetic material such as plastic and are cemented together as shown in FIG. 4 by a suitable adhesive.

Each magnet assembly 64 in effect constitutes a single permanent magnet having axially spaced north and south poles designated N and S on FIG. 4. The lines of flux produced by each magnet assembly 64 are shown in dotted lines (on one assembly in FIG. 4). It should be understood that each assembly 64 would have a similar set of flux lines with the north and south pole orientation of each magnet assemblies 64 being the same from one end of unit 48 to the other. The direction of water flow through the tube 58 is indicated by an arrow 76, such flow being essentially parallel to the lines of flux produced by magnet assemblies 64.

As shown in FIG. 4, it is preferable that the north pole of each magnet assembly 64 be positioned upstream of the flow through tube 58 and that the south pole of each magnet assembly 64 be positiond downstream of such flow, i.e., starting at flow inlet, the poles of each magnet assembly 64 will be in a north-south orientation.

While the novel magentic and agitator combination described above is shown and described for use in a gas fired water heater, it should be understood that it could also be used effectively in an electric water heater.

OPERATION

The water in chamber 22 will be heated by the hot gasses and products of combustion passing through flue tubes 20 from burner 26 or in an electric heater, the water will be heated by an electric heating element means of any suitable design. As previously explained, a not uncommon problem in the operation of water heaters of the type involved herein is the tendency (depending primarily on local water conditions) of certain dissolved solid materials in the water to precipitate out of the water being heated, which precipitated materials will settle out and accumulate in the bottom portion of the water heater tank and become adhered to the interior of the tank. Such scale accumulations, if not periodically removed by some kind of a tank cleaning procedure, will gradually build up, creating an adverse effect on the heating efficiency of the unit and will ultimately cause a premature failure of the heater tank.

With the heater of the present invention, when hot water is withdrawn from the chamber 22 through outlet fitting 42 into a commercial water system for example, cold water will simulataneously flow from a source of water under pressure into and through magnetic device 48 and then into and through agitator assembly 28. Water flowing through agitator assembly 28 will flow into tank chamber 22 through openings 34 and 35 and venturi fittings 46 and 47 of the agitator assembly.

While the system phenomena produced by magnetic device 48 is not completely understood, the magnetic lines of force produced will magnetize iron in the water causing the iron particles to agglomerate. Such agglomerated particles will in turn provide crystallization sites for precipitation of calcium carbonates and other minerals in the water. Thus, as the water flows from device 48 into the heater through agitator assembly 28 and is heated therein, the precipitation of solid particles will tend to build up more readily on each other than on the interior surfaces of the water heater. Such tendency of the precipitated solids to remain as separate particles as opposed to becoming adhered to the tank interior (as scale) will enable the agitator assembly 28 to perform its intended function more efficiently than would be the case if the magnetic device 48 was not in the system. It has also been observed that with the use of the magnetic device 48 in the system, the precipitated solids will retain a more sludge-like consistency as opposed to forming a hard scale. This also will enable the agitator assembly 28 to perform its intended function in a more efficient manner.

The multiple jets of water flowing into the water heater tank through openings 34 and 35 and venturi 46 will be directed across the bottom of the tank, causing a general agitation of the water in the lower part of the tank. Such general stirring action in the lower portion of the tank will cause solid materials which have either settled to the bottom or are in the process of settling to the bottom to be maintained in suspension in the water so that ultimately at least a portion of such materials will be carried upwardly in the tank and out the hot water outlet 42.

Vertical central venturi 47 will direct a jet of water vertically upwardly in the tank. This vertical stream will enhance the stirring action referred to above and will also serve to aid in the upward circulation of particles to the outlet 42.

To create the desired stirring action referred to above, it is important that the water flowing into the tank from agitator assembly 28 be in the form of jet-like streams. This is accomplished by maintaining the aggregate size of the small openings in the agitator assembly less than the size of the tubular portions of the agitator assembly itself. By maintaining this relationship, the velocity of the water flowing into the tank through the openings in the agitator assembly will be greater than the velocity of water flowing into the tubular portions of the assembly. It should be appreciated that the use of venturi fittings 46 and 47 is optional. A plurality of small openings like openings 34 and 35 could be used in place of venturi fittings 46 and 47.

To summarize, the action of the magnetic device 48 will tend to reduce scale formations on the interior parts of the heater and thereby keep more of the solid materials in the form of particles. The stirring action created by the agitator assembly will cause solid materials which have either settled to the bottom or are in the process of settling to the bottom to be maintained in suspension in the water. The normal upward circulation of the water in the tank as it is heated (plus the action of central venturi fitting 47) will cause such suspended particles to be carried upwardly in the tank and eventually out through outlet 42. Such combined action of the magnetic device and agitator assembly has proven effective to substantially reduce (and in some instances eliminate) harmful accumulations of scale in the bottom of the tank even in water situations where relatively large amounts of dissolved materials are present.

I claim:

1. A water heater for heating water containing iron molecules comprising:

a water tight tank means adapted to contain water under pressure;

a source of heat for heating water inside said tank means;

a hot water outlet means located in the top portion of said tank means for periodically withdrawing heated water from the top portion of said tank means;

a cold water inlet means located in the bottom portion of said tank means for admitting cold water into said tank means when hot water is withdrawn from said hot water outlet means;

a magnetic means having an inlet connected to a source of water under pressure and an outlet connected to said cold water inlet means, said magnetic means including a flow passageway means extending between said inlet and said outlet and a plurality of permanent magnet means mounted on said flow passageway means and spaced along the length thereof, each of said permanent magnet means producing magnetic lines of force which pass through the interior of said flow passageway means so that water flowing thru said flow passageway means will pass thru said magnetic lines of force, said flow passageway means of said magnetic means being in the form of a tubular member made of non-metallic material, said permanent magnet means including spaced sets of doughnut-shaped permanent magnets mounted on said tubular member, each of said spaced sets of permanent magnets having a north pole on one end face thereof and a south pole on the other end face thereof, said permanent magnets producing lines of flux which extend parallel to the direction of flow of water through said tubular member, spacer members of non-magnetic material are positioned between each group of doughnut-shaped permanent magnet members and said magnetic means includes a jacket made of non-magnetic material mounted on said tubular member and enclosing said permanent magnet members and spacer members;

an agitator assembly means mounted in the bottom portion of said tank, said agitator assembly means including a tubular member connected to said cold water inlet means, said tubular member extending into said water tight tank means and having a plurality of small openings therein spaced along the length thereof to direct multiple streams of water under pressure into the tank each time water is drawn out of the top portion of said tank means through said hot water outlet means, said plurality of openings in said tubular member positioned so that said multiple streams of water will be directed to sweep over the bottom of the tank means to create a stirring action in the lower portion of said tank means to thereby cause solid materials which have either settled to the bottom or are in the process of settling to the bottom to be maintained in suspension in the water so that ultimately at least a portion of such materials will be carried upwardly in said tank means and out said hot water outlet means, the relationship of the aggregate size of the small openings in said tubular member to the size of said tubular member itself is such that the velocity of the water flowing into said tank means through said plurality of openings in said tubular member is greater than the velocity of water flowing into said tubular member from said cold water inlet means to thereby create the desired stirring action in the bottom portion of said tank means.

* * * * *